US005146723A

United States Patent [19]

Greenwood et al.

[11] Patent Number: 5,146,723

[45] Date of Patent: Sep. 15, 1992

[54] DRYWALL CONSTRUCTION

[76] Inventors: Frank D. Greenwood, 400 Keewatin Avenue, Toronto, Ontario, Canada, M4P 2A5; Kazimir Kobielski, 24 Dustan Crescent, Toronto, Ontario, Canada, M4J 4G5

[21] Appl. No.: 660,985

[22] Filed: Feb. 27, 1991

Related U.S. Application Data

[63] Continuation of Ser. No. 396,971, Aug. 22, 1989, abandoned.

[51] Int. Cl.[5] ..... E04B 2/00

[52] U.S. Cl. ..... 52/287; 52/241; 52/242; 52/39

[58] Field of Search ..... 52/241, 242, 290, 238, 52/287, 481

[56] References Cited

U.S. PATENT DOCUMENTS 3,027,605 4/1962 Nelsson ..... 52/241
4,512,118 4/1985 Rasmussen ..... 52/241 X

FOREIGN PATENT DOCUMENTS 2338359 8/1977 France ..... 52/241

*Primary Examiner*—David A. Scherbel
*Assistant Examiner*—Wynn E. Wood
*Attorney, Agent, or Firm*—Smart & Biggar

[57] ABSTRACT

An interior wall mounting device comprising an elongated element having a base plate and at least one side flange projecting laterally from the base plate. The free edge of the side flange is turned inwardly to form a channel opening in a direction normal to the base plate and outwardly therefrom. The channel is adapted to have a plurality of studs securable laterally to the channel and shaped to receive the edge of a planar sheet securable against the studs to form a wall.

5 Claims, 13 Drawing Sheets

DRYWALL CONSTRUCTION

This application is a continuation of application Ser. No. 07/396,971, filed Aug. 22, 1989 now abandoned.

FIELD OF THE INVENTION

This invention relates to a device for interior wall installation in building construction.

BACKGROUND OF THE INVENTION

The present method of installing an interior wall is a consuming and cumbersome process. In the present method metal tracks with channels are attached to the floor and ceiling and spaced, vertical wall studs interconnect the tracks. The wall substrate is then attached to the studs. If the substance is drywall the grooves between successive sheets must be taped and plastered, after which the wall is painted. Finally, a baseboard is usually attached to the bottom of the wall to provide a finished appearance, and a cornice may be applied at the top of the wall, either preformed or of plaster.

It is an object of the invention to provide a baseboard and/or cornice for simplified construction of the interior wall of a building.

SUMMARY OF THE INVENTION

Essentially the invention consists of an interior wall mounting device comprising an elongated element having a base plate and at least one side flange projecting laterally from the base plate. The free edge of the side flange is turned inwardly to form a channel opening in a direction normal to the base plate and outwardly therefrom. The channel is adapted to have a plurality of studs securable laterally to the channel and shaped to receive the edge of a planar sheet securable against the studs to form a wall.

BRIEF DESCRIPTION OF DRAWINGS

Example embodiments of the invention are shown in the accompanying drawings in which.

DESCRIPTION OF PREFERRED EMBODIMENT

Figure 1:
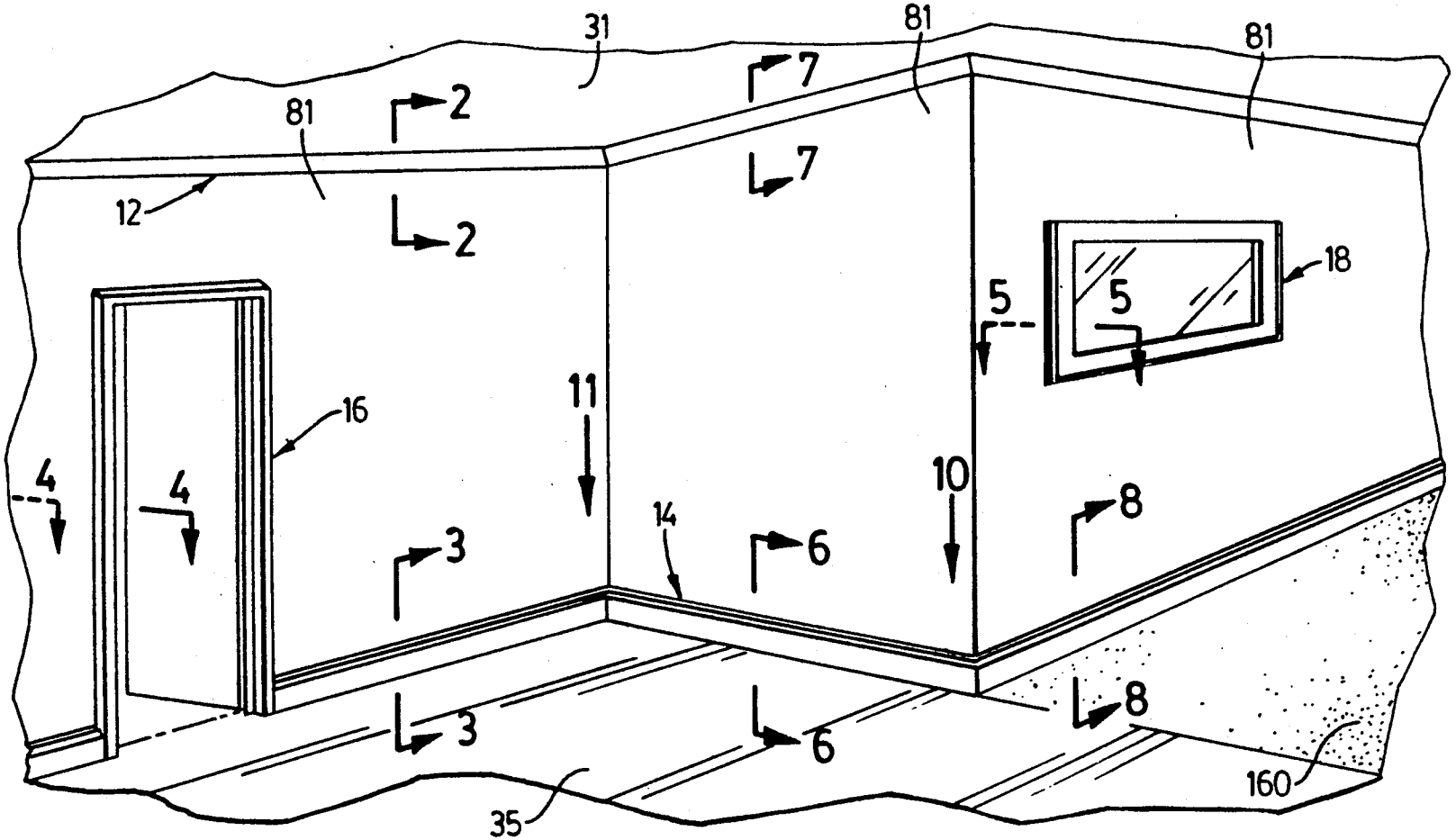
FIG. 1 is a perspective view of a room indicating sites of use of an interior wall mounting device for interior wall construction.

The example embodiments of the invention shown in the drawings each consist of an interior wall mounting device comprising a ceiling element 12, floor element 14, a door element 16, and a window element 18.

Figure 2:
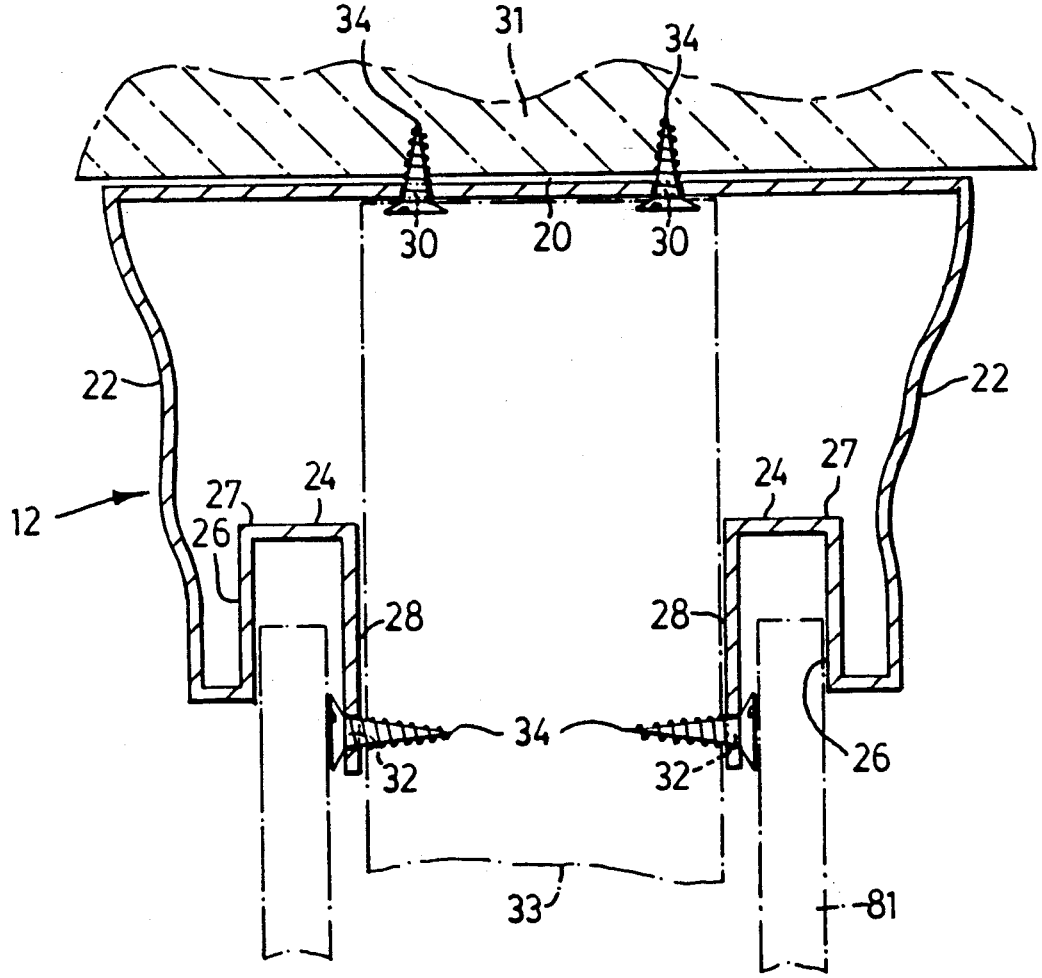
FIG. 2 is a vertical cross sectional view of the ceiling element of an interior wall mounting device for an interior double sided wall, taken along line 2—2 of FIG. 1.

Ceiling element 12, shown in FIG. 2, consists of a base plate 20 having, extending therefrom, a pair of space side flanges 22, terminating in a pair of downwardly opening channels 24 which are spaced apart a distance corresponding to the thickness of a wall stud 33. Channels 24 are each defined by a downwardly projecting outer side wall 26 contiguous with the side flange, a bottom 27 and an inner side wall 28 lying in a plane normal to the base plate. Base plate 20 and inner side wall 28 carry apertures 30 and 32 respectively for receiving fastening elements 34 which are shown as screws.

Figure 3:
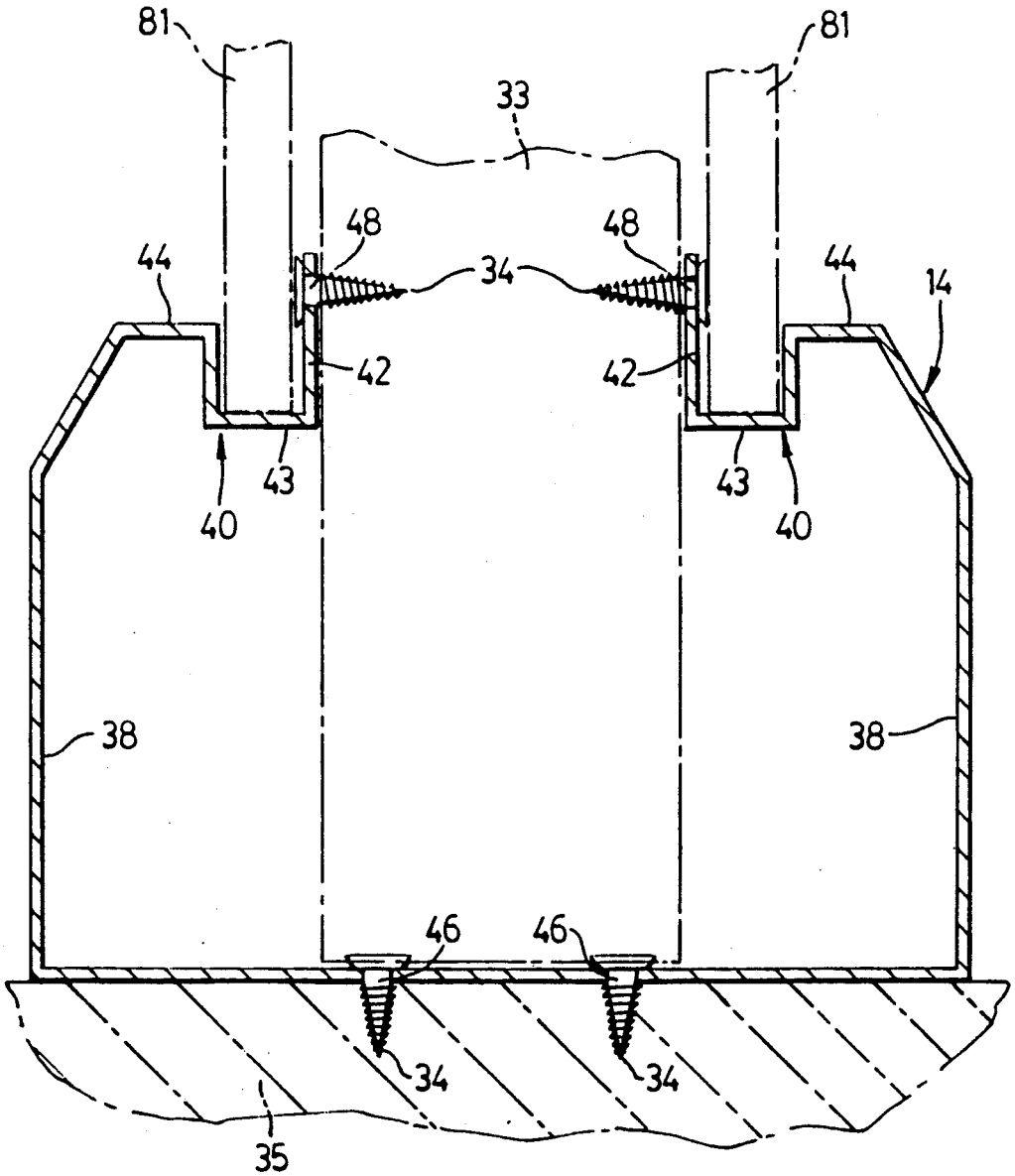
FIG. 3 is a vertical cross sectional view of the floor element of an interior wall mounting device for an interior double sided wall, taken along line 3—3 of FIG. 1.

Floor element 14, shown in FIG. 3, consists of a base plate 36 having, extending therefrom, a pair of spaced side flanges 38 terminating in a pair of upwardly opening channels 40 which are space apart a distance corresponding to the thickness of wall stud 33. Channels 40 are each defined by an upwardly projecting inner side wall 42, a bottom 43, and an upwardly projecting outer side wall 44 contiguous with the side flange. Base plate 36 and inner plate 42 carry apertures 46 and 48 respectively for receiving fastening elements 34.

Figure 4:
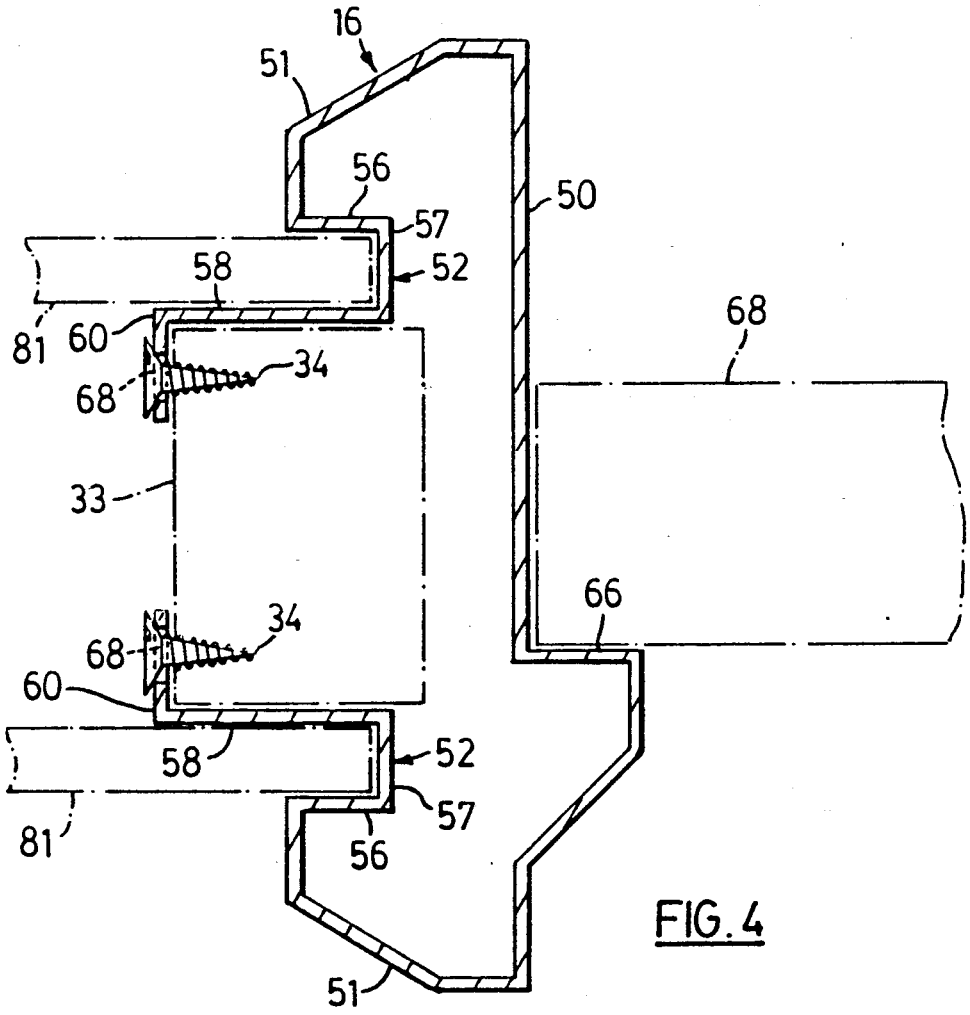
FIG. 4 is a horizontal cross sectional view of an interior wall mounting device adapted to provide a door frame, taken along line 4—4 of FIG. 1.

A door frame element 16 is shown in FIG. 4 and consists of a face plate 50 having, extending therefrom, a pair of side flanges 51, each terminating in a channel 52, the channels being spaced apart a distance corresponding to the thickness of wall stud 33. Channels 52 are each defined by an outer side wall 56 contiguous with the side flange, a bottom 57, and an inner side wall 58 lying in a plane normal to the base plate lying against wall stud 33. The outer end of inner side wall 58 of each channel 52 terminates in a channel extension plate 54. A stop 64 projects from face plate 50 and protrudes into the door area, with an abutment face 66 parallel to the face of a closed door 68. Channel extension plates 54 carry apertures 68 for receiving fastening elements 34.

Figure 5:
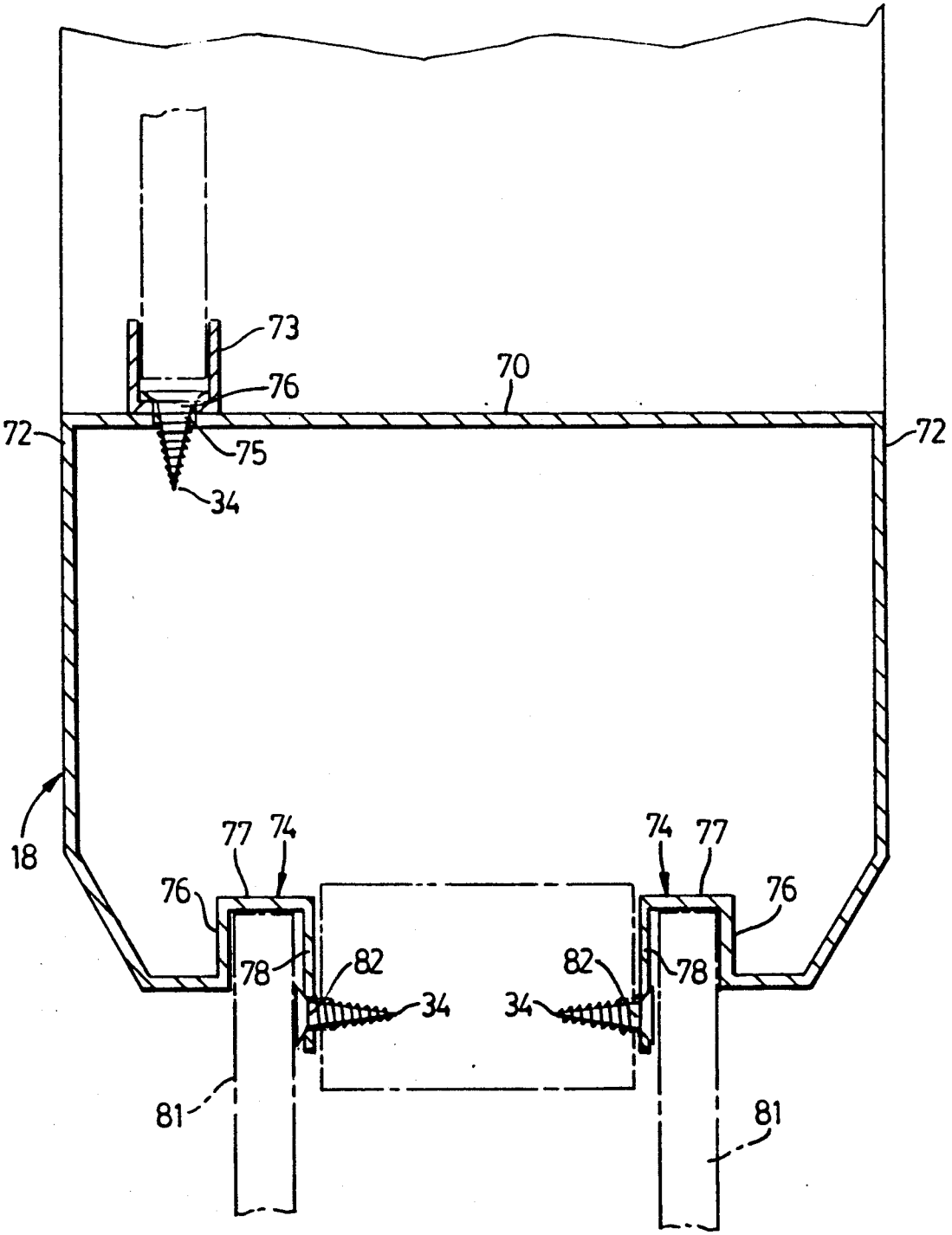
FIG. 5 is a horizontal cross sectional view of an interior wall mounting device adapted to provide a window frame, taken along line 5—5 of FIG. 1.

A window frame element 18 shown in FIG. 5, consists of a face plate 70 adjacent the window having, extending therefrom, a pair of side flanges 72 spaced apart a predetermined distance and terminating in a pair of channels 74. Extending from face plate 70 opposite side flanges 72 is a window receiving channel 73. Face plate 70 and window receiving channel 73 carry receiving apertures 75 and 76 respectively for receiving fastening elements 34. Channels 74 are each defined by an outer side wall 76 contiguous with the side flange, a bottom 77, and an inner side wall 78 lying in a plane normal to the base plate. Inner side wall 78 of channel 74 carries apertures 82 for receiving fastening elements 34.

In the use of the embodiment shown in FIGS. 2 and 3 ceiling element 12 is fastened by screws 34 to ceiling 31 through apertures 30. Floor element 14 is aligned vertically with ceiling element 12 and fastened to floor 35 by screws 34 through apertures 46. When ceiling element 12 and floor element 14 have been secured in place, the ends of vertical wall studs 33 are located in these elements in the usual manner. Then ceiling element 12 and floor element 14 are securely fastened by screws 34 to wall studs 33 through apertures 32 for ceiling element 12 and aperture 48 for floor element 14. Following this, where necessary, door element 16 and window element 18 are fastened to wall studs 33 by screws 34 through aperture 68 for door element 16 and aperture 82 for window element 18. All elements are now ready to receive a series of wall substrate panels 81 which are mounted by inserting the upper edge portions of the panels into ceiling channel 24 which is deeper than, channel 40 in floor element 14, channel 52 in door element 16, and channel 74 in window element 18, and then dropping the bottom of the panels into channels 40, 52, and 74. Channels 24, 40, 52, and 74 are narrow enough to adequately secure panels 81. Screws 34 protruding from apertures 32 and 38 may provide an extra means of securing panel 81 by gouging and gripping the back of panels 81 upon insertion of the edges of the panels into the channels.

Figure 6:
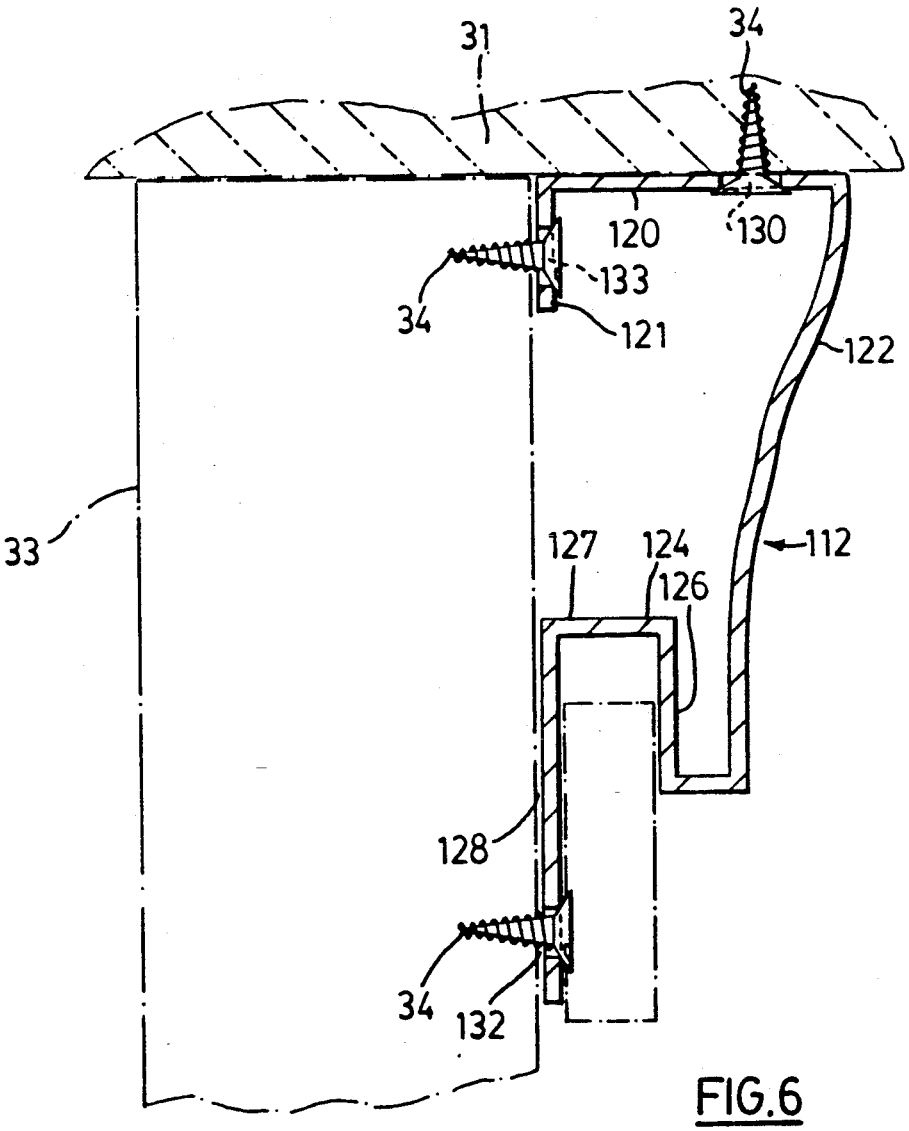
FIG. 6 is a vertical cross sectional view of the ceiling element of an interior wall mounting device for an interior single sided wall, taken along line 6—6 of FIG. 1.

A variation of ceiling element 12, indicated by numeral 112 in FIG. 6 consists of a base plate 120 and extending therefrom a side flange 122 terminating in a downwardly opening channel 124. Channel 124 is defined by a downwardly projecting outer side wall 126 contiguous with the side flange, a bottom 127, and a downwardly projecting inner side wall 128 lying in a plane normal to base plate 120. A top rest plate 121 projects downwardly from base plate 120 in the plane of inner side wall 128 of channel 124. Base plate 120, inner side wall 128, and rest plate 121 carry apertures 130, 132, and 133 respectively for receiving fastening elements 34.

Figure 7:
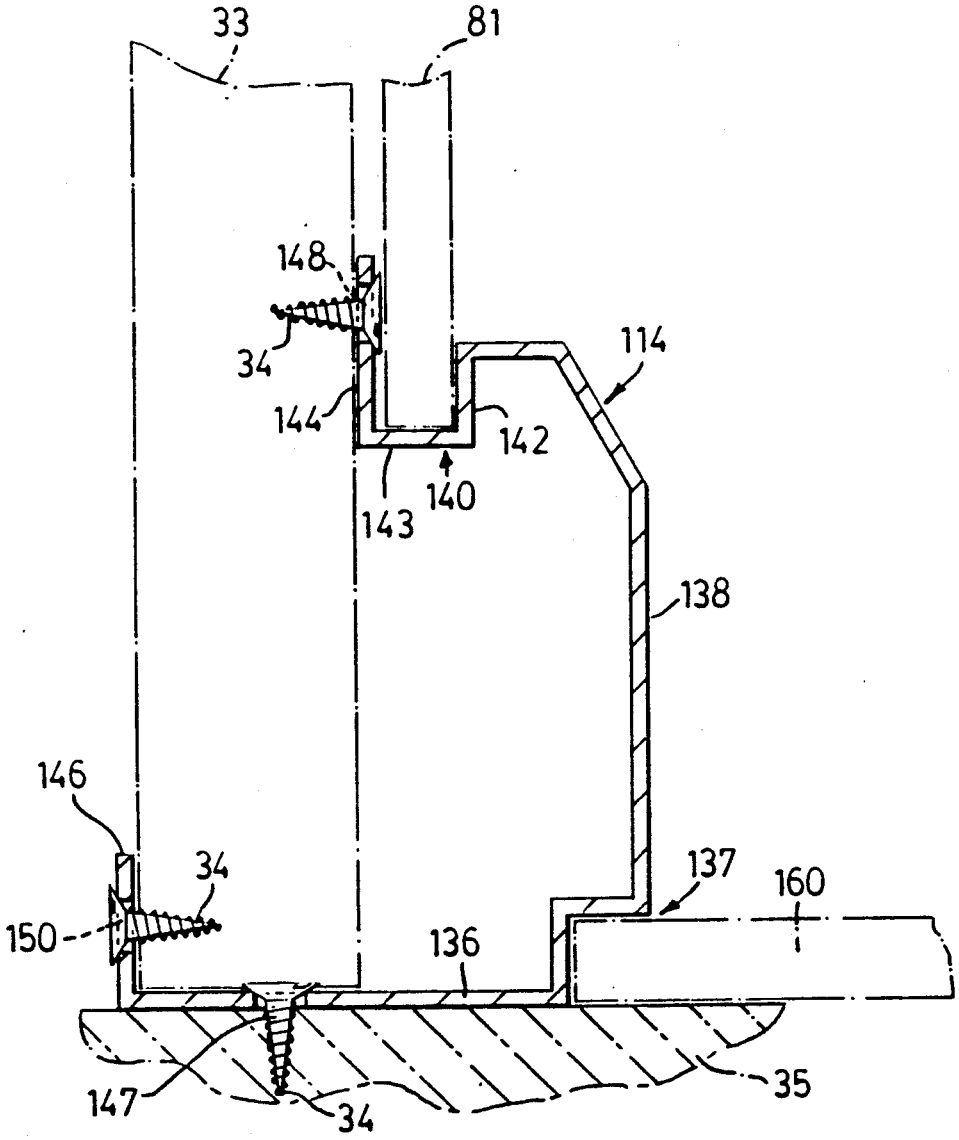
FIG. 7 is a vertical cross sectional view of the floor element of an interior wall mounting device for an interior single side wall, with a variation in the side flange-base plate junction, taken along line 7—7 of FIG. 1.

A variation of floor element 14, indicated by numeral 114 in FIG. 7, consists of a base plate 136 having, extending therefrom, a side flange 138 terminating in an upwardly opening channel 140. Channel 140 is defined by an upwardly projecting outer side wall 142 contiguous with side flange 138, a bottom 143, and an upwardly projecting inner side wall 144 lying in a plane normal to base plate 136. Extending from base plate 136 is an upwardly projecting rest plate 146 located to lie against wall stud 33. Base plate 136, inner side wall 144, and rest plate 146 carry apertures 147, 148, and 150 respectively for receiving fastening elements 34. In this embodiment the junction of base plate 136 and side flange 138 is recessed to form a cavity 137.

In the use of the embodiment shown in FIGS. 6 and 7, ceiling element 112 is fastened by screws 34 to ceiling 31 through aperture 130. Floor element 114 is aligned vertically with ceiling element 112 and is then fastened to floor 31 by screws 34 through aperture 146. Wall studs 33 are inserted into elements 112 and 114 in the usual manner. Ceiling element 112 is securely fastened by screws 34 to wall studs 33 through apertures 132 and 133 and floor element 114 is securely fastened by screws 34 to the wall studs through apertures 148 and 150. Where required, door elements 16 and window elements 18 are appropriately positioned as described above. All elements are now ready to receive wall substrate panels 81 which are mounted by flexing and inserting the edge portions of the panels in channels 124, 140 and where necessary, channels 52 and 74 for the door and window elements. Wall substrate panels 81 are then fastened to wall studs 33. The edge of carpet 160 is inserted into cavity 137 to improve appearance of the combination. It will be appreciated that rest plate 121 of ceiling element 112 and rest plate 146 of floor element 114 are two aspects of the same concept and either may be used as desired, i.e. The rest plate may be located to abut either side of stud 33.

Figure 8:
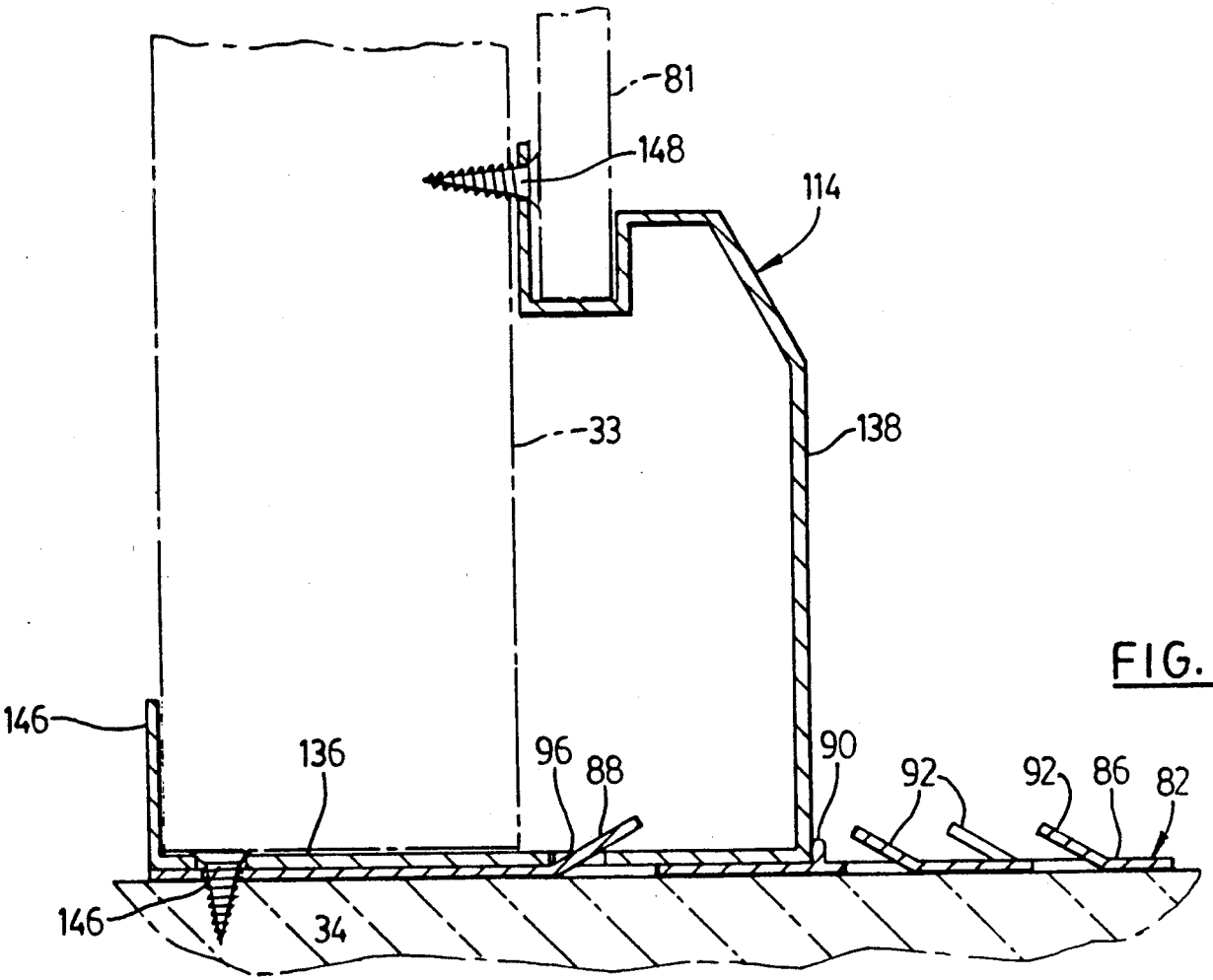
FIG. 8 is a vertical cross sectional view similar to FIG. 6 including a carpet gripping device, taken along line 8—8 of FIG. 1.
Figure 9:
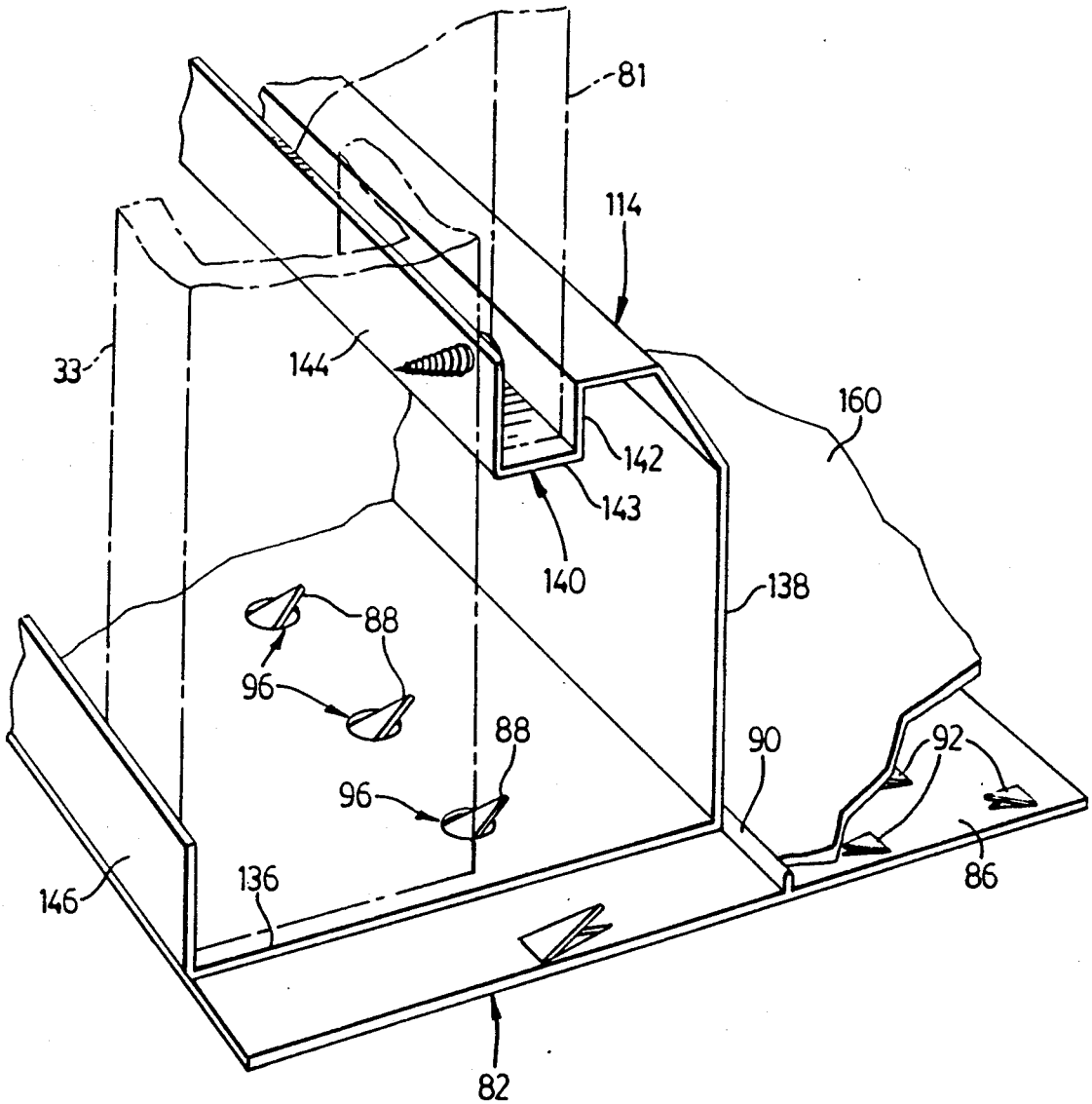
FIG. 9 is a perspective view of an interior wall mounting device of FIG. 8.

A carpet gripping device 82, associated with floor element 14 or 114 and shown in FIGS. 8 and 9, consists of a separate further plate 86 which carries a locator rail 90 perpendicular to the plate and running longitudinally the length of the plate. A row of barbs 88 projects from plate 86 on one side of rail 90 at an upward angle towards the rail and an array of barbs 92 projects from the plate on the other side of the rail at an upward angle towards the rail. Base plate 94 carries a row of apertures 96 for receiving the upward projecting row of barbs 88.

In the use of the embodiment shown in FIGS. 8 and 9, floor element 114 (or floor element 14) and gripping device 82 are located on the floor, the gripping device being underneath the floor element, with barbs 88 engaging apertures 96 and with locator rail 90 abutting the base of side flange 138. Floor element 114 (or element 14) is fastened to the floor by screws 34 through aperture 147 (or aperture 46). Then ceiling element 12 (or element 112) is vertically aligned with the floor element and the previously described procedure is followed to mount wall substrate panels 81, after which a carpet 160 is laid with its edges being held down by the array of barbs 92 on gripping device 82.

Figure 10:
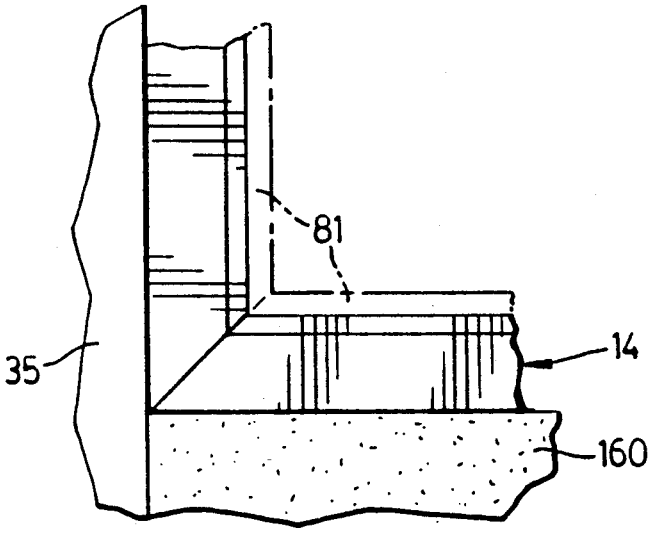
FIG. 10 is a plan view of the outside corner of the junction of two walls taken in the direction of arrow 10 in FIG. 1.
Figure 11:
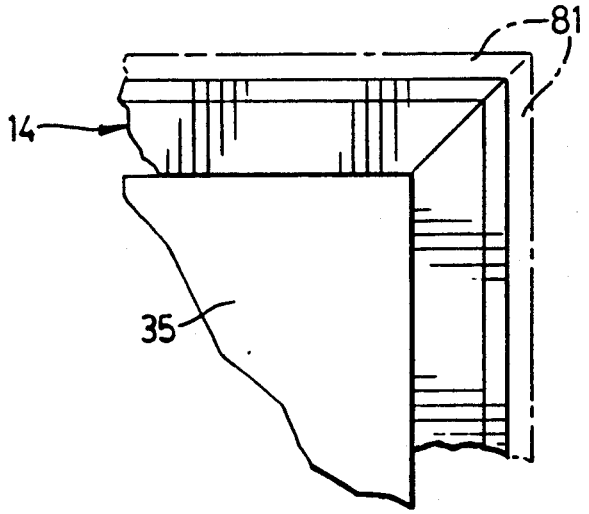
FIG. 11 is a plan view of the inside corner of the junction of two walls taken in the direction of arrow 11 in FIG. 1.

The corners of side flanges 38 and 138 of floor elements 14 and 114 may be mitred as shown in FIG. 10 and FIG. 11 for an outside corner and inside corner respectively. The same mitring may be used in the corners of the ceiling elements.

Figure 12:
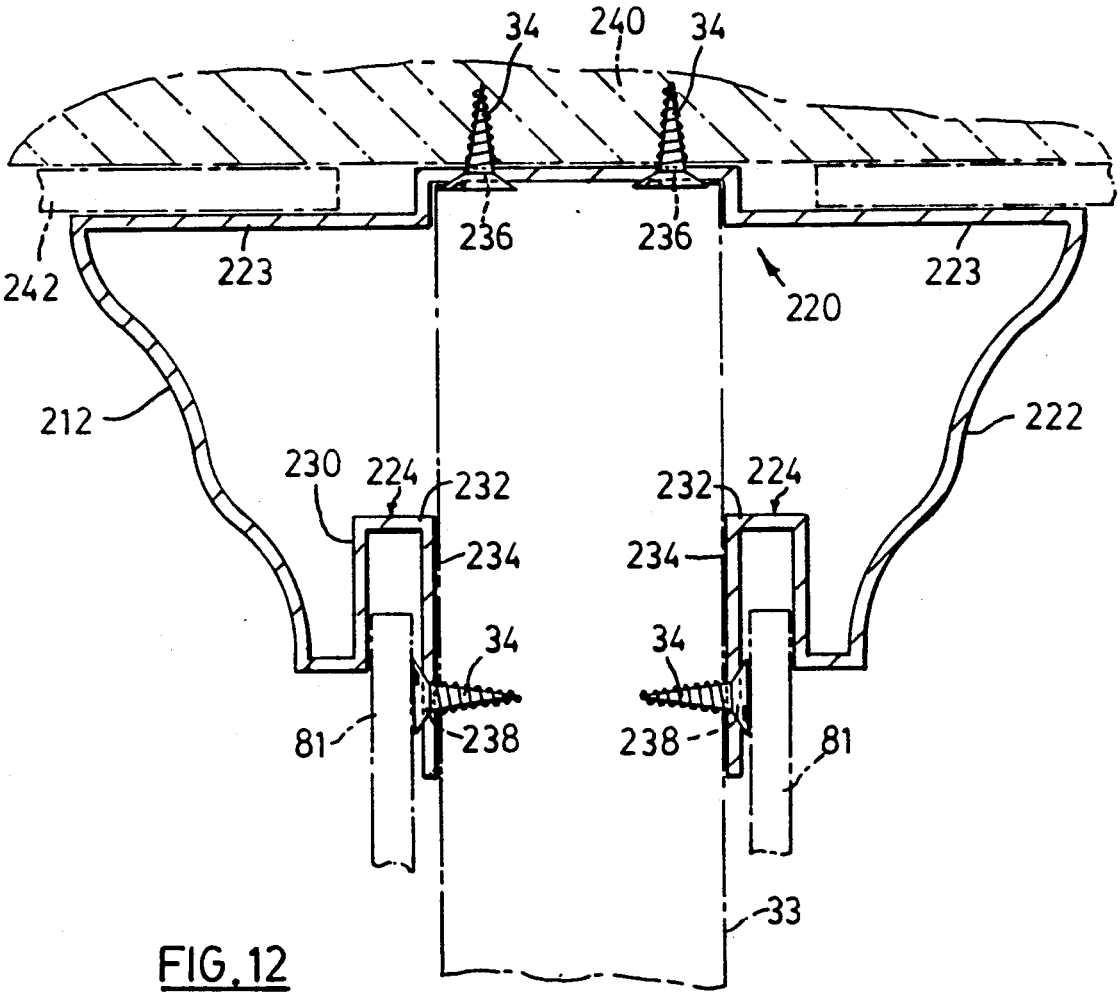
FIG. 12 is a vertical cross sectional view of the ceiling element of an interior wall mounting device for use with ceiling substrate.

A variation of ceiling element 12 is shown in FIG. 12 of the drawings. That embodiment consists of ceiling element 212 with a base plate 220 having, extending therefrom, a side flange 222 which terminates in a downwardly opening channel 224. Base plate 220 is recessed at each lateral edge to form a ledge 223. Channel 224 is defined by a downwardly projecting outer side wall 230, a bottom 232, and a downwardly projecting inner side wall 234 lying in a plane normal to base plate 220. Base plate 220 and inner side wall 234 carry apertures 236 and 238 respectively for receiving fastening elements 34.

In the use of the embodiment shown in FIG. 12, ceiling element 212 is fastened by screws 34 to ceiling joists 240 through aperture 236. Floor elements 14 or 114 are attached to the floor as described above. Wall studs 33 are inserted into elements 212 and, either floor element 14, or 114, in the usual manner. Ceiling element 212 is securely fastened to wall studs 33 by screws 34 through aperture 238. Wall substrate panels 81 are mounted inserted in the usual manner. Ceiling substrate panels 242 are mounted by inserting the edge portions of the panels into the cavity created by ledge 223 and ceiling joists 240, and then fastening the panel to the ceiling joists.

Figure 13:
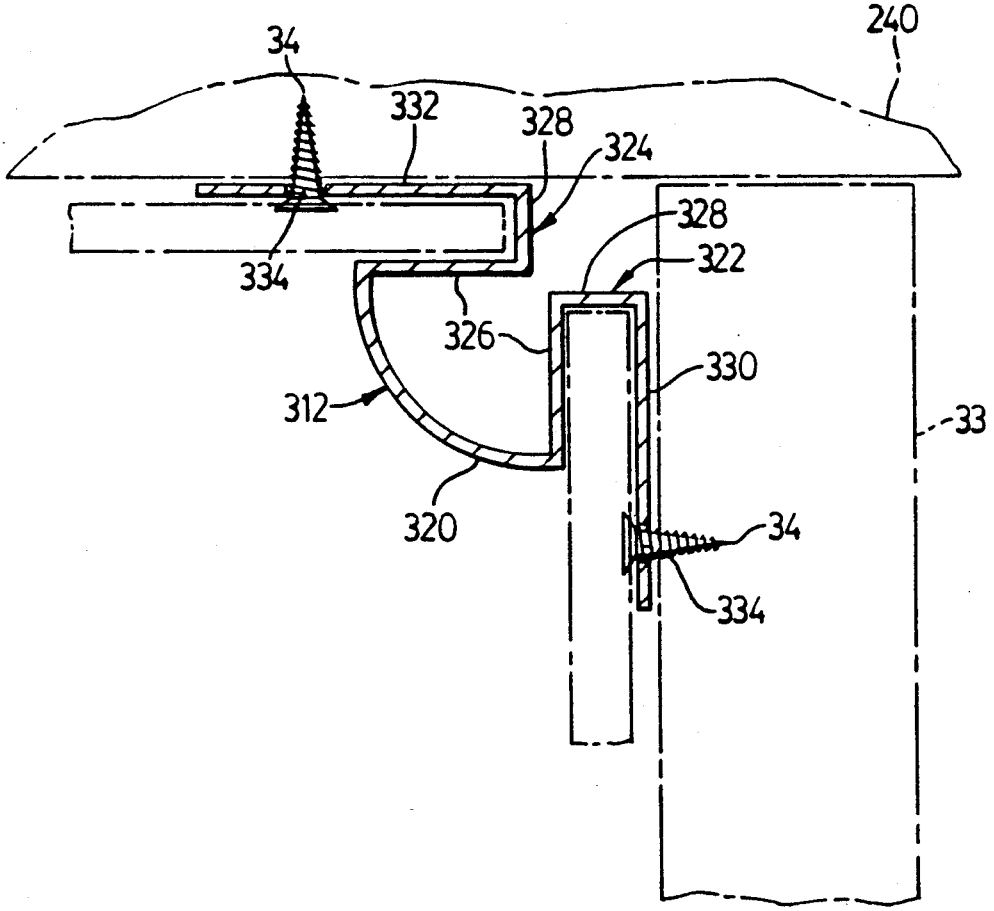
FIG. 13 is a vertical cross sectional view in elevation of a cornice in the form of a corner bead mounting device for installing with an interior wall and ceiling substrate at an inside corner junction.
Figure 14:
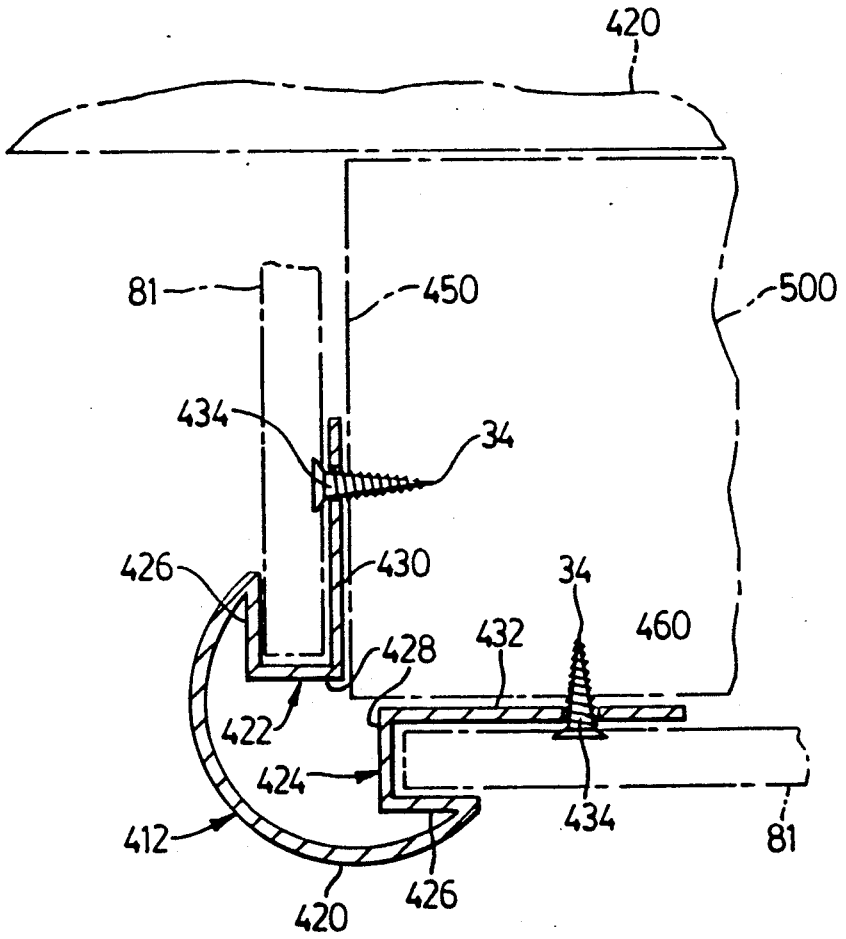
FIG. 14 is a vertical cross sectional view in elevation of a cornice in the form of a corner bead mounting device for installing with an interior wall and ceiling substrate at an outside corner junction.

In FIGS. 13 and 14 a variation of ceiling element 12 provides an inside corner cornice in the form of a bead 312 and an outside corner cornice in the form of a bead 412. In FIG. 14 bead 312 consists of an arcuate face plate 320 with the lateral edges thereof terminating in channels 322 and 324. Channel 322 is defined by an outer side wall 326, a bottom 328 and an inner side wall 330 adapted to lie against wall stud 33. Channel 324 is defined by an outer side wall 326, a bottom 328 and an inner side wall 332 adapted to lie against ceiling joist 240. Channels 322 and 324 open in a direction normal to and away from each other and carry apertures 334 for receiving fastening elements 34. In FIG. 15 bead 412 consists of an arcuate face plate 420 with the lateral edges thereof terminating in channels 422 and 424. Channel 422 is defined by an outer side wall 426, a bottom 428 and an inner side wall 430 adapted to lie against exposed surface 450. Channel 424 is defined by an outer side wall 426, a bottom 428 and an inner side wall 432 adapted to abut exposed surface 460. Channels 422 and 424 open in a direction normal to and away from each other and carry apertures 434 for receiving fastening elements 34. Channels 422 and 424 are adapted to lie against exposed surfaces 450 and 460 of frame 500 of a two tiered ceiling.

In the embodiments shown in FIGS. 13 and 14, ceiling element 312 may be used with ceiling and wall panels where there is an inside corner junction, i.e. at the junction of ceiling joists 240 and wall studs 33, to have inner side wall 332 lying against joists 240 and inner side wall 330 lying against wall studs 33. Ceiling element 312 is secured to ceiling joists 240 by screws 34 through apertures 334. Any necessary floor elements are then vertically aligned and secured to the floor in the manner described above. Wall studs 33 are then located in the runners of floor element 14 with the sides of their upper ends lying against inner side wall 330 of ceiling element 312. Ceiling element 312 is then firmly secured to wall studs 33 by screws 34 through apertures 334. Ceiling element 412 may be used at an outside corner junction, i.e. at the corner junction of the two exposed surfaces when a two tiered ceiling frame is installed, and is located so that arcuate face plate 420 envelops the outside corner with inner side wall 430 lying against exposed surface 450 and inner side wall 432 lying against exposed surface 460. Ceiling element 412 is securely fastened by screws 34 to the frame of the two tiered ceiling through apertures 434. Wall substrate panels 81 are then inserted into channels 422 and 424 in the manner described above.

It will be appreciated that the floor, ceiling, door, and window elements of the wall mounting device may be preformed into various shapes which may be especially efficient when used to construct closets or showers; otherwise they may be roll formed on the site.

It will also be appreciated that the various elements may be roll formed from any suitable material such as sheet metal or aluminum, or the elements may be formed by using various plastics in appropriate moulds. Also the side flanges of the various elements may be pre-finished with suitable materials such as marble, paint, or plastics.

The term "wall substrate" as used herein refers to sheet materials such as drywall, gyproc, pressboard, and panelling.

We claim:

1. A wall mounting device comprising a single continuous elongated floor element having a base plate for attachment to a floor and having opposing terminating ends forming an open trough, said element having at least one side flange upstanding from the base plate to form a baseboard and terminating in an upwardly opening channel, said device further comprising a single continuous elongated ceiling element having a base plate for attachment to a ceiling and having opposing terminating ends forming an open trough, said ceiling element having at least one side flange downwardly projecting from the base plate to form a cornice and terminating in a downwardly opening channel, the inside walls of the channels each lying in a plane normal to its associated base plate, the floor and ceiling elements being juxtaposable whereby a plurality of vertical wall studs are securable laterally to the outer faces of the inside walls of the channels to bear downwardly on the base plate of the floor element, whereby a planar sheet is receivable in the channels and securable against the studs to form a permanent wall.

2. A device as claimed in claim 1 in which the floor element comprises a pair of spaced parallel baseboards and the ceiling element comprises a pair of spaced parallel cornices, whereby the plurality of vertical studs is locatable between the channels of each element and securable thereto, and a pair of planar sheets are receivable in the channels and securable against the studs to form a double wall.

3. A device as claimed in claim 1 in which each channel is defined by an outer side wall contiguous with the side flange, a bottom, and an inner side wall lying in a plane normal to the base plate.

4. A device as claimed in claim 3 in which the floor and ceiling elements are securable to a floor and ceiling respectively through a plurality of apertures in the base plate, and where said floor and ceiling elements are further securable to the studs through a plurality of apertures in the inner side wall of each channel.

5. A device as claimed in claim 1 in which the base plate of the ceiling element has at least one side edge recessed laterally to form a ledge.

* * * * *